US006565352B2

(12) United States Patent
Nielsen et al.

(10) Patent No.: US 6,565,352 B2
(45) Date of Patent: May 20, 2003

(54) SMOKE DENSITY MONITOR

(76) Inventors: Ken E. Nielsen, 512 SE. 32nd St., Ft. Lauderdale, FL (US) 33316; Poul K. Sorensen, Golvej 7, 9440 Abybro (DK)

( * ) Notice: Subject to any disclaimer, the term of this patent is extended or adjusted under 35 U.S.C. 154(b) by 150 days.

(21) Appl. No.: 09/828,531

(22) Filed: Apr. 9, 2001

(65) Prior Publication Data

US 2002/0182552 A1 Dec. 5, 2002

(51) Int. Cl.[7] ..... F23N 5/24; G01N 21/53

(52) U.S. Cl. ..... 431/13; 431/76; 340/630; 356/438; 250/215; 250/573

(58) Field of Search ..... 431/13, 18, 76; 250/573, 574, 577; 340/628, 630; 73/23.31, 23.33; 356/438

(56) References Cited

U.S. PATENT DOCUMENTS

| | | | | | |
|---|---|---|---|---|---|
| 3,847,487 | A | * | 11/1974 | Boll | 356/438 |
| 3,931,462 | A | | 1/1976 | Exton | |
| 3,944,834 | A | | 3/1976 | Chuan et al. | |
| 3,954,342 | A | | 5/1976 | Boeke | |
| 3,976,884 | A | | 8/1976 | Acton et al. | |
| 3,994,601 | A | * | 11/1976 | Brugger | 356/438 |
| 4,018,513 | A | | 4/1977 | Boeke | |
| 4,043,743 | A | | 8/1977 | Seider | |
| 4,079,622 | A | | 3/1978 | Cocola et al. | |
| 4,241,282 | A | | 12/1980 | Tresch et al. | |
| 4,249,244 | A | | 2/1981 | Shofner et al. | |
| 4,413,911 | A | * | 11/1983 | Rice et al. | 356/438 |
| 4,583,859 | A | * | 4/1986 | Hall, II | 356/438 |
| 4,622,845 | A | | 11/1986 | Ryan et al. | |
| 4,647,780 | A | * | 3/1987 | Dunkel | 250/573 |
| 4,652,756 | A | * | 3/1987 | Ryan et al. | 250/343 |
| 4,768,158 | A | | 8/1988 | Osanai | |
| 4,823,015 | A | * | 4/1989 | Galvin et al. | 250/573 |
| 4,896,047 | A | * | 1/1990 | Weaver et al. | 250/573 |
| 5,028,790 | A | * | 7/1991 | McGowan et al. | 250/573 |
| 5,210,702 | A | | 5/1993 | Bishop et al. | |
| 5,281,815 | A | | 1/1994 | Even-Tov | |
| 5,371,367 | A | | 12/1994 | DiDomenico et al. | |
| 5,401,967 | A | | 3/1995 | Stedman et al. | |
| 5,424,842 | A | * | 6/1995 | Poorman | 356/438 |
| 5,489,777 | A | | 2/1996 | Stedman et al. | |
| 5,591,975 | A | | 1/1997 | Jack et al. | |
| 5,637,872 | A | | 6/1997 | Tulip | |
| 5,748,325 | A | | 5/1998 | Tulip | |
| 5,751,423 | A | * | 5/1998 | Traina et al. | 250/574 |
| 5,760,911 | A | * | 6/1998 | Santschi et al. | 356/438 |
| 5,831,267 | A | | 11/1998 | Jack et al. | |

OTHER PUBLICATIONS

Banner Engineering Corp., Minneapolis, U.S.A. (612)544–3164 Catalog Pages (4 pgs. including pp. 47, 49 Analog Omni–Beam, Fiber End Assembly sheet, and Glass Fiber Optics—Custom sheet).

* cited by examiner

*Primary Examiner*—Sara Clarke
(74) *Attorney, Agent, or Firm*—Paul S. Rooy, P.A.

(57) ABSTRACT

A smoke density monitor for mounting on a ship smokestack. The smoke density monitor provides a transmitter head and a receiver head mounted to a smokestack. The transmitter head and receiver head are optically connected with a density monitor by means of fiber-optic lines. The density monitor is electrically connected to an alarm monitor, which at pre-set smokestack smoke densities activates an alarm and/or shuts down the ship's burner(s). An optional recorder may be connected to the alarm monitor to preserve a record of smoke density. Each transmitter and recorder head has an optical head slidably attached to a head housing for ease of servicing and maintenance.

25 Claims, 3 Drawing Sheets

SMOKE DENSITY MONITOR

BACKGROUND OF THE INVENTION

1. Field of the Invention

This invention relates to opacity measurement devices, and in particular to a smoke or dust density monitor.

2. Background of the Invention

Ships are used extensively in the transportation of goods all over the world. During recent years the ecological impact of these vessels has come under heightened scrutiny. One of the environmental aspects of ship operation are the emissions which emerge from the ship's funnel, or smokestack. From an environmentally-friendly point of view, it is desirable to minimize smoke emissions from ship smokestacks.

Increasingly, regulations are being passed to encourage reduced ship smokestack emissions. For example, during the year 2000 the state of Alabama is testing a program to monitor ship boiler burner smoke emissions at the smokestack. In the year 2001, smoke emissions monitoring will be required for ships operating in Alabama waters.

Thus it is becoming increasingly important to provide an efficient, accurate apparatus to measure ship burner smoke emissions. Ideally, the smoke monitor should be located on the smokestack itself, and provide alarm and burner shutdown functions if smoke emissions exceed the appropriate thresholds. In addition, a means of providing a record of emissions levels would be desirable.

Existing Designs

One approach to measuring the density of smoke emanating from a ship's funnel has been to place a twelve volt incandescent light bulb on one side of the funnel, and a photovoltaic cell diametrically opposed on the opposite funnel side. Theoretically, the photo-voltaic cell then emits a voltage signal inversely proportional to the smoke density within the funnel.

A number of problems exist with the incandescent light bulb/photovoltaic cell approach. One problem involves ambient light pollution. Because the photovoltaic cell reacts to all visible light, during bright daylight the voltage out from the photovoltaic cell will be greater than during the night. Thus, ambient light pollution can cause smoke density measurement inaccuracies. It would be desirable to use a smoke detector whose operation is not based on measurements taken in the visible light spectrum.

Another problem with the incandescent light bulb/photovoltaic cell approach involves equipment reliability. A typical twelve-volt incandescent light bulb will burn only 7,000 hours, and then requires replacement. In addition, the type of photovoltaic cell used in this application is generally a selenium cell, which bums out after approximately 10,000 hours. Exacerbating this reliability problem is the physical placement of conventional funnel smoke density measurement light bulbs and photovoltaic cells: they are generally placed high on the smokestack, rendering replacement laborious and difficult. In addition, these elements are typically secured with three or more screws, making replacement quite a chore. It would be desirable to have a slide-in, slide-out installation for easier maintenance.

Still another problem associated with the incandescent light bulb/photovoltaic cell approach is the tendency of the incandescent light bulb to heat up during operation. A hot light bulb attracts dust, which coats the bulb, and reduces its visible light output. This reduction of light output may be interpreted by the photovoltaic cell to be increased smoke density, and lead to measurement errors.

SUMMARY OF THE INVENTION

Accordingly, it is an object of the present invention to provide a smoke density monitor which does not operate in the visible light spectrum. Design features allowing this object to be accomplished include a transmitter head which emits infrared light, which in turn is detected by a receiver head. Advantages associated with the accomplishment of this object include elimination of the light pollution associated with incandescent light bulb/photovoltaic cell, and consequently increased smoke density monitor accuracy.

It is another object of the present invention to provide a smoke density monitor which provides increased reliability. Design features allowing this object to be accomplished include a transmitter head and a receiver head connected to a density monitor via fiber-optic lines. Benefits associated with the accomplishment of this object include reduced necessity of maintenance, and hence decreased costs.

It is still another object of this invention to provide a smoke density monitor which is easily maintained. Design features enabling the accomplishment of this object include a transmitter head and receiver head which are easily removed from the smokestack upon which they are mounted. Advantages associated with the realization of this object include easier maintenance, less time required to access the transmitter head and receiver head, and consequently less maintenance cost.

It is another object of the present invention to provide a smoke density monitor which discourages dust from settling on the transmitter and receiver heads. Design features allowing this object to be accomplished include a trap chamber, and a sealing air supply communicating with a head housing exit chamber, which in turn communicates with a smokestack bore through an exit chamber mouth. Benefits associated with the accomplishment of this object include a chamber where particulate matter may be trapped, and also airflow movement away from the transmitter or receiver heads, thereby reducing dust build-up on same, and consequently reduced smoke density measurement errors.

It is yet another object of this invention to provide a smoke density monitor which is relatively inexpensive. Design features allowing this object to be achieved include the use of off-the-shelf components, and the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIG. 1. Sheet two contains FIG. 2. Sheet three contains FIG. 3.

DETAILED DESCRIPTION OF THE PREFERRED EMBODIMENT

Figure 1:
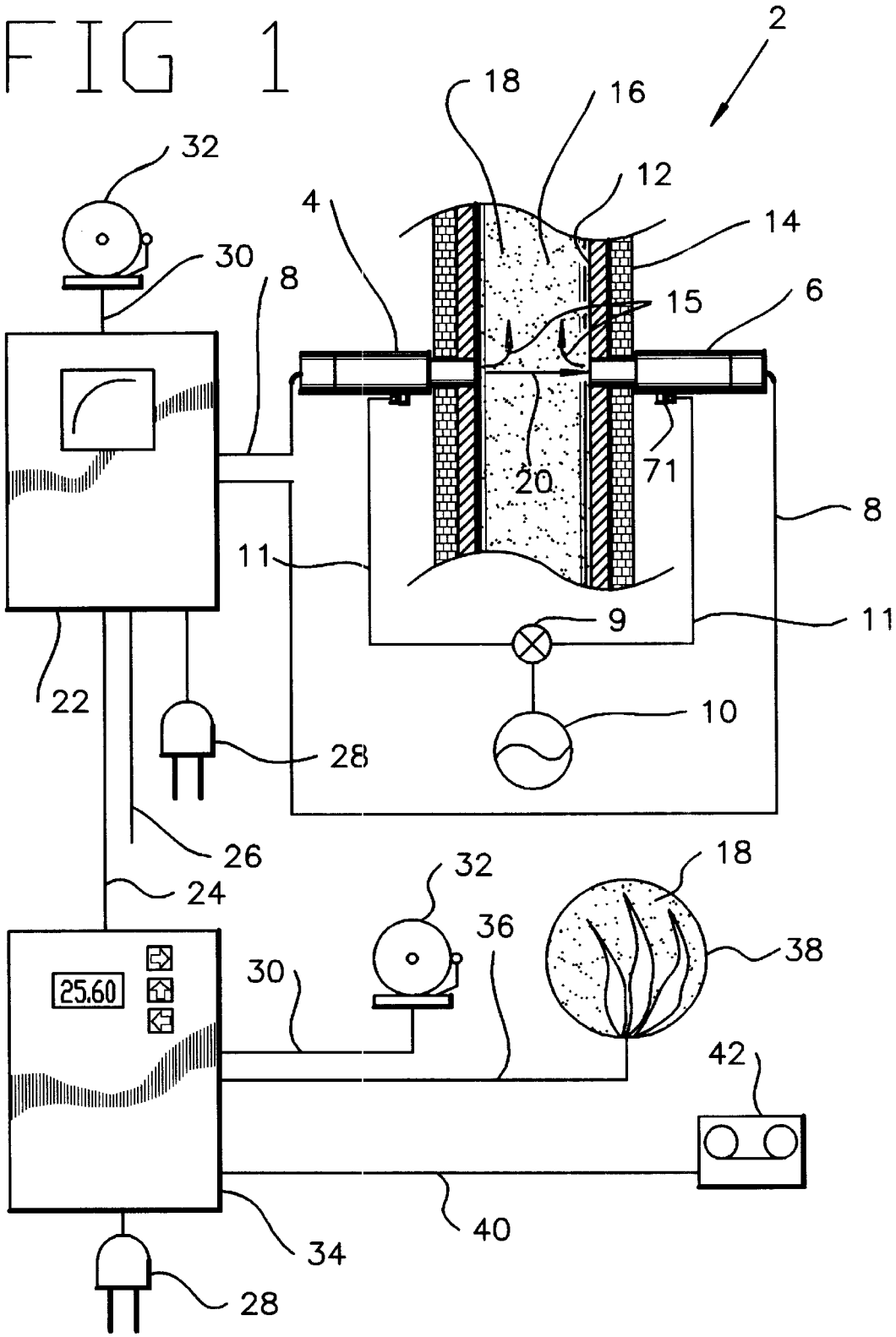
FIG. 1 is a schematic view of a smoke density monitor.

FIG. 1 is a schematic view of smoke density monitor 2. Smoke density monitor 2 comprises transmitter head 4 installed on smokestack 12 in optical alignment with receiver head 6. Transmitter head 4 and receiver head 6 are optically connected to density monitor 22 by means of fiber-optic lines 8.

In operation, density monitor 22 sends an infrared signal through fiber-optic line 8 to transmitter head 4, which directs same to receiver head 6 through smokestack bore 16 as indicated by arrow 20. The infrared signal emitted from transmitter head 4 is picked up by receiver head 6, diminished in strength as dictated by the density of smoke 18 within smokestack bore 16, and sent back to density monitor 22 through fiber-optic line 8. Smoke density monitor 22 interprets the infrared light from receiver head 6 and converts it into an electrical signal, which is then used by alarm monitor 34 to sound an alarm 32, shut down burner 38, etc.

Alarm 32 is connected to density monitor 22 by means of line to alarm 30. Density monitor 22 is connected to power supply 28. In addition, an optional line 26 is connected to density monitor 22, to which optional equipment may be connected. By virtue of this connection, when a specified density threshold of smoke 18 is reached, alarm 32 may sound.

Density monitor 22 is electrically connected with alarm monitor 34 by means of line to alarm monitor 24. Alarm monitor 34 is powered by power supply 28. Alarm 32 is electrically connected to alarm monitor 34 by means of line to alarm 30. By virtue of this connection, when a specified smoke density threshold is reached, alarm 32 may sound. Recorder 42 is electrically connected with alarm monitor 34 by means of optional line to recorder 40. By virtue of this connection, an on-going record of the density of smoke 18 within smokestack bore 16 may be preserved. In addition, burner 38 is electrically connected to alarm monitor 34 by means of line to burner 36. By virtue of this connection, when a specified smoke density threshold is reached, burner 38 may be shut down.

Figure 2:
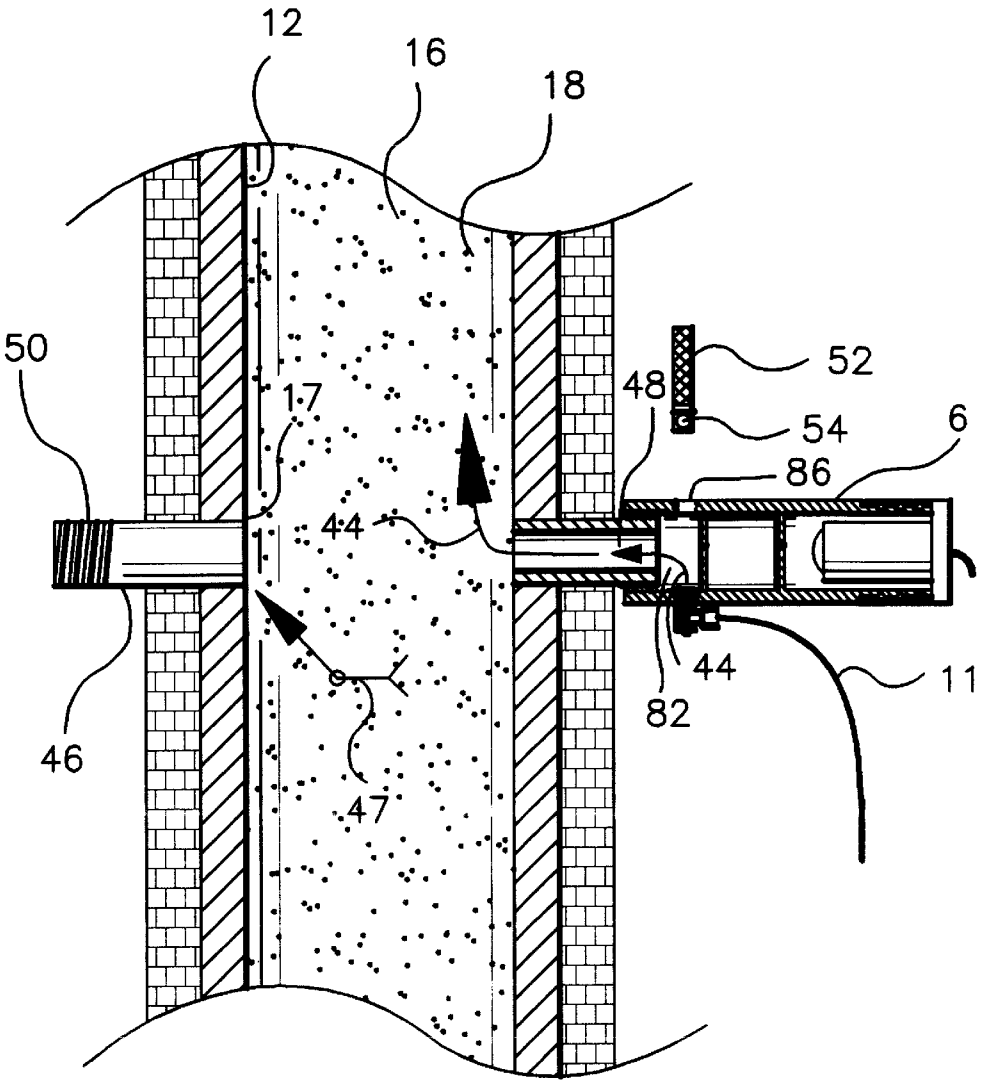
FIG. 2 is a side cross-sectional view of a transmitter head ready to be mounted on a smokestack, and a receiver head already mounted on the smokestack.
Figure 2:
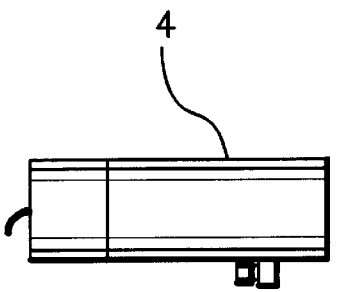
Figure 3:
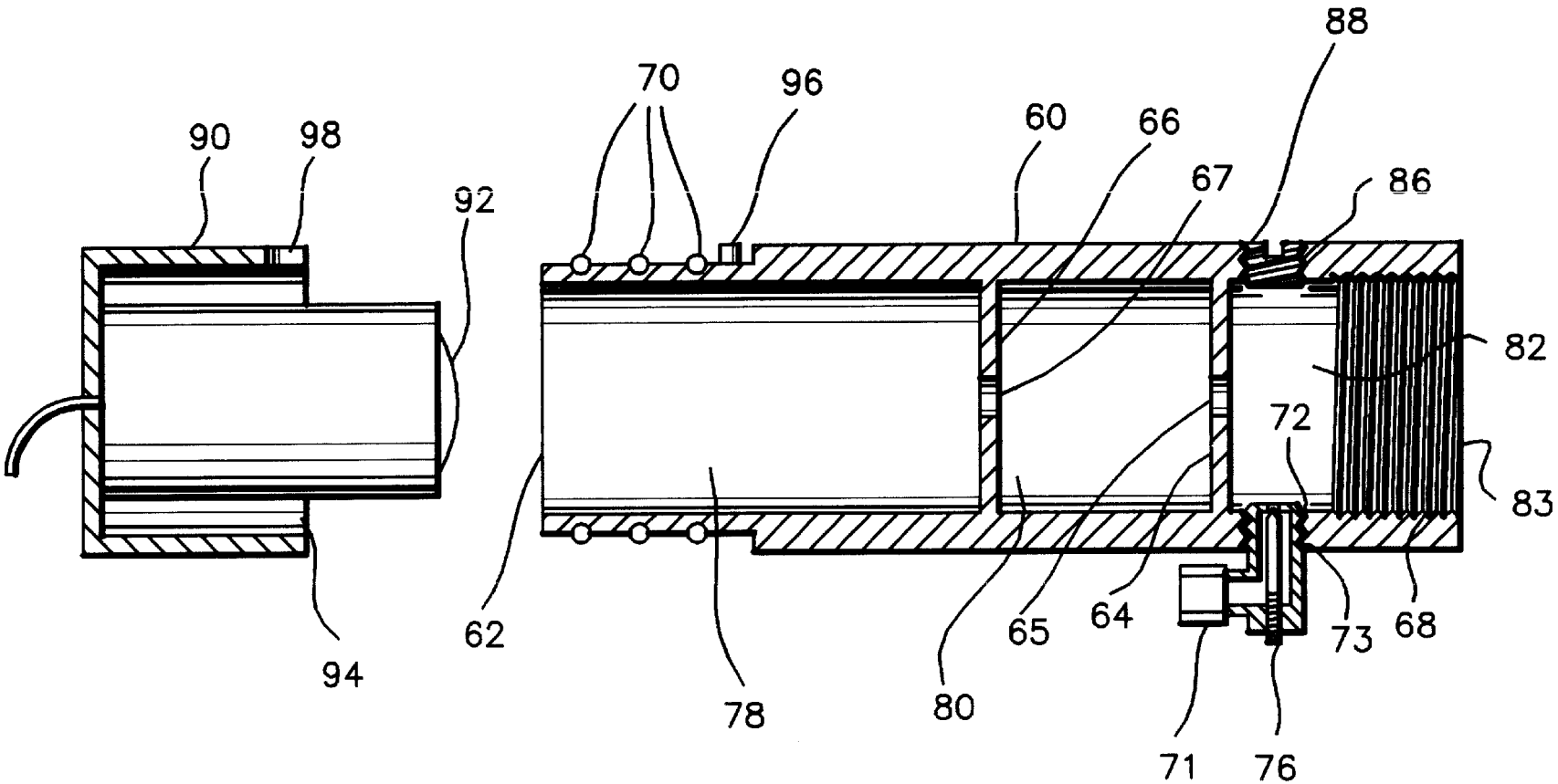
FIG. 3 is a side cross-sectional view of a head housing and its mating optical head.

FIG. 2 is a side cross-sectional view of transmitter head 4 ready to be mounted on smokestack 12, and receiver head 6 already mounted on smokestack 12. Transmitter head 4 and receiver head 6 are mounted to smokestack 12 by means of mounting tubes 46 having respective mounting tube bores 48. If smokestack 12 is wrapped in smokestack insulation 14, mounting tube extends far enough away from smokestack 12 to extend beyond insulation 14. Each mounting tube is attached to smokestack 12 over a smokestack aperture 17. In the preferred embodiment, mounting tubes 46 were attached to smokestack 12 at smokestack apertures 17 by means of a weld attachment, as indicated by weld symbol 47. Referring now also to FIG. 3, each mounting tube 46 comprises a means of attachment to a head housing 60. In the preferred embodiment, the attachment means comprised a mounting tube thread 50 sized to mate with a head housing thread 68 disposed in exit chamber mouth 83. Thus, transmitter head 4 and receiver head 6 are in optical communication with smokestack bore 16 through their respective mounting tubes 46.

FIG. 3 is a side cross-sectional view of head housing 60 and its mating optical head 90. Transmitter head 4 and receiver head 6 are identical components; their function as transmitter or receiver is determined by their respective connection with density monitor 22. Thus, transmitter head 4 and receiver head 6 comprise identical optical heads 90 and head housings 60, and mount on identical mounting tubes 50, and the following discussion applies to both equally.

Head housing 60 comprises head chamber 78, trap chamber 80 and exit chamber 82. Head chamber 78 is defined at one extreme by head chamber mouth 62, and at an opposite extreme by second bulkhead 66. Trap chamber 80 is defined at one extreme by second bulkhead 66, and at an opposite extreme by first bulkhead 64. Exit chamber 82 is defined at one extreme by first bulkhead 64 and at an opposite extreme by exit chamber mouth 83.

Head chamber 78 is separated from trap chamber 80 by second bulkhead 66, and communicates with trap chamber 80 through second bulkhead aperture 67 in second bulkhead 66. Trap chamber 80 is separated from exit chamber 82 by first bulkhead 64, and communicates with exit chamber 82 through first bulkhead aperture 65 in first bulkhead 66.

Optical head 90 comprises optical lens 92 and optical head bore 94. Optical head bore 94 is sized to admit an extreme of head housing 60 at which head chamber mouth 62 is disposed. Head chamber mouth 62 is sized to admit optical head lens 92. A sealing means is disposed around an outer surface of head housing 60 at an extreme of head housing 60 at which head chamber mouth 62 is disposed.

In the preferred embodiment, the sealing means comprised at least one O-ring 70 disposed around an outer surface of head housing 60 adjacent head chamber mouth 62, and optical head bore 94 was sized to frictionally admit the at least one O-ring 70. In the preferred embodiment, head housing 60 comprised pin 96 disposed on an outer surface of head housing 60, and optical head 90 comprised slot 98 sized to admit pin 96, whereby an angular orientation of optical head 90 may be fixed relative to head housing 60.

Exit chamber 82 communicates with an exterior of head housing 60 by mean of tester aperture 86 and sealing air fitting bore 72. Unless a tester 52 is being used to calibrate smoke density monitor 2, tester aperture 86 is hermicatally blocked by plug 88.

Referring now also to FIGS. 1 and 2, sealing air from sealing air supply 10 is supplied to exit chamber 82 through check valve 9, sealing air lines 11, and sealing air fitting 71. In the preferred embodiment, sealing air fitting 71 was attached to head housing 60 by means of sealing air fitting thread 74 which mates with sealing air fitting bore thread 73 disposed in sealing air fitting bore 72. In addition, sealing air fitting 71 comprises sealing air fitting valve 76, by means of which the rate of sealing air flowing into exit chamber 82 may be regulated. Check valve 9 is a one-way valve which permits the flow of sealing air from sealing air supply 10 to sealing air fitting 71, but not the reverse.

An important advance embodied in the instant invention is the provision for preventing dust from settling upon, and impairing the effectiveness of, optical head lenses 92. Two features embodied in the instant invention join to accomplish this objective.

First, sealing air flows from scaling air supply 10 through sealing air lines 11, check valve 9 and sealing air fitting 71 into exit chamber 82. Due to the hermetic nature of the fit between optical head 90 and head housing 60, and between plug 88 and tester aperture 86 (or, when tester 52 is being used, between tester 52 and tester aperture 86) the only escape path for sealing air from exit chamber 82 is through exit chamber mouth 83, mounting tube 46, and smokestack aperture 17 into smokestack bore 16, as depicted by mows 44 in FIG. 2 and arrows 15 in FIG. 1. This constant flow of sealing air out of exit chamber 82 into smokestack bore 16 prevents dust and particulates from entering head housing 60.

Second, trap chamber 80 is disposed between head chamber 78 (wherein optical head lens 92 is disposed) and exit chamber 82. Any dust or particulate matter which somehow crosses the sealing air barrier in exit chamber 82 and mounting tube 46 will find itself in the still air of trap chamber 80, and fall to the floor of trap chamber 80 as urged by gravity.

Thus the combined effects of sealing air and trap chamber 80 minimize the dust and particulate matter which can settle on optical head lens 92, thus maximizing the accuracy of the instant smoke density monitor 2.

As may be observed in FIG. 2, smoke density monitor 2 may be calibrated by inserting the tester lens 54 of tester 52 in the optical path between optical head senses 92, with no smoke 18 or other particulate matter in smokestack bore 16. Tester 52 is typically equipped with a sealing means such as an O-ring to render its fit with head housing 60 hermetic.

Smoke density monitor 2 is installed by attaching mounting tubes 46 to smokestack 12, attaching transmitter head 4 and receiver head 6 to respective mounting tubes 46, optically connecting transmitter head 4 and receiver head 6 to density monitor 22, attaching sealing air supply 10 to sealing air fittings 71 through check valve 9, and electrically connecting the remaining components. Mounting tubes 46 must be attached to smokestack 12 such that all first bulkhead apertures 65 and second bulkhead apertures 67 are aligned. One way of easily accomplishing this is to insert a close-fitting pipe through the pair of opposing mounting tube bores 48 prior to finalizing the attachment. Sealing air supply 10 may be a stand-alone blower, or simply a take-off from the boiler forced draft fan.

Optical heads 90 may be quickly and easily slid off their respective head housings 60 for maintenance, and as easily slid back on again. In the preferred embodiment, optical head lenses 92, fiber-optic line 8, density monitor 22, alarm monitor 34, alarms 30 and recorder 42 were commercially available components.

While a preferred embodiment of the invention has been illustrated herein, it is to be understood that changes and variations may be made by those skilled in the art without departing from the spirit of the appending claims.

DRAWING ITEM INDEX

| | |
|---|---|
| 2 | smoke density monitor |
| 4 | transmitter head |
| 6 | receiver head |
| 8 | fiber-optic line |
| 9 | check valve |
| 10 | sealing air supply |
| 11 | sealing air line |
| 12 | smokestack |
| 14 | insulation |
| 15 | arrow |
| 16 | smokestack bore |
| 17 | smokestack aperture |
| 18 | smoke |
| 20 | arrow |
| 22 | density monitor |
| 24 | line to alarm monitor |
| 26 | optional line |
| 28 | power supply |
| 30 | line to alarm |
| 32 | alarm |
| 34 | alarm monitor |
| 36 | line to burner |
| 38 | burner |
| 40 | optional line to recorder |
| 42 | recorder |
| 44 | arrow |
| 46 | mounting tube |
| 47 | weld symbol |

-continued

DRAWING ITEM INDEX

| | |
|---|---|
| 48 | mounting tube bore |
| 50 | mounting tube thread |
| 52 | tester |
| 54 | tester lens |
| 60 | head housing |
| 62 | head chamber mouth |
| 64 | first bulkhead |
| 65 | first bulkhead aperture |
| 66 | second bulkhead |
| 67 | second bulkhead aperture |
| 68 | head housing thread |
| 70 | O-ring |
| 71 | sealing air fitting |
| 72 | sealing air fitting bore |
| 73 | sealing air fitting bore thread |
| 74 | sealing air fitting thread |
| 76 | sealing air fitting valve |
| 78 | head chamber |
| 80 | trap chamber |
| 82 | exit chamber |
| 83 | exit chamber mouth |
| 86 | tester aperture |
| 88 | plug |
| 90 | optical head |
| 92 | optical head lens |
| 94 | optical head bore |
| 96 | pin |
| 98 | slot |

I claim:

1. A smoke density monitor comprising an infrared light transmitter head and an infrared light receiver head optically attached to a density monitor by means of fiber-optic line, each said transmitter head and receiver head comprising a head housing which comprises a head chamber, an optical head lens being disposed in said head chamber.

2. The smoke density monitor of claim 1 wherein said head housing further comprises an exit chamber separated from said head chamber by a first bulkhead, a first bulkhead aperture being disposed in said first bulkhead, said first bulkhead aperture and said optical head lens being in optical alignment.

3. The smoke density monitor of claim 2 further comprising a sealing air supply in communication with said exit chamber, sealing air from said sealing air supply entering said exit chamber, and exiting said exit chamber through an exit chamber mouth.

4. The smoke density monitor of claim 3 wherein each said head housing further comprises a trap chamber separated from said head chamber by a second bulkhead and from said exit chamber by said first bulkhead, a second bulkhead aperture disposed in said second bulkhead, said first bulkhead aperture, said second bulkhead aperture and said optical head lens being in optical alignment, whereby dust or particulate matter which somehow crosses a sealing air barrier in said exit chamber will find itself in still air within said trap chamber and fall to a floor of said trap chamber as urged by gravity.

5. The smoke density monitor of claim 3 wherein said sealing air supply communicates with said exit chamber by means of a sealing air fitting, said sealing air fitting comprising a sealing air fitting valve whereby a flow of sealing air into said exit chamber may be regulated.

6. The smoke density monitor of claim 5 wherein said sealing air supply communicates with said sealing air fitting through a sealing air line and a check valve, whereby a direction of sealing air flow is limited to flow from said sealing air supply to said exit chamber.

7. The smoke density monitor of claim 5 wherein said exit chamber further comprises a tester aperture hermetically and removably blocked by a plug, said tester aperture being sized to admit a tester when said plug is removed.

8. The smoke density monitor of claim 1 wherein each said transmitter head and receiver head further comprise an optical head slidably attached to said head housing, and means of hermetically sealing the slidable attachment between said optical head and said head housing, said optical head comprising said optical head lens, whereby said optical head may be quickly and easily slid off said head housing for maintenance or servicing.

9. The smoke density monitor of claim 8 wherein each said head housing is mounted to a smokestack by means of a mounting tube attached to said smokestack, each said head housing being attached to one said mounting tube, whereby each said heed chamber communicates with a smokestack bore through a mounting tube bore.

10. The smoke density monitor of claim 9 wherein said head housing is attached to said mounting tube by means of a head housing thread sized to mate with a mounting tube thread.

11. The smoke density monitor of claim 10 wherein said mounting tube is welded to said smokestack around a smokestack aperture.

12. The smoke density monitor of claim 11 wherein said means of hermetically sealing the slidable attachment between said optical head and said head housing comprises at least one O-ring around said head housing and an optical head bore in said optical head, said optical head bore being sized to frictionally admit said at least one O-ring.

13. The smoke density monitor of claim 12 wherein said head housing further comprises a pin, and said optical head further comprises a slot sized to admit said pin, whereby an angular relationship between said optical head and said head housing may be fixed.

14. A smoke density monitor comprising a transmitter head and a receiver head mounted on a smokestack, a density monitor optically attached to said transmitter head and said receiver head by means of fiber-optic line, and a sealing air supply in communication with said transmitter head and said receiver head, whereby sealing air from said air supply travels through said transmitter head and said receiver head into a smokestack bore, thus preventing smoke in said smokestack bore from impinging upon optical head lenses disposed within said transmitter head and said receiver head.

15. The smoke density monitor of claim 14 wherein said transmitter head and said receiver head each comprise a head housing which comprises an exit chamber separated from a head chamber by a first bulkhead, a first bulkhead aperture in said first bulkhead, one said optical head lens being disposed in said head chamber, said first bulkhead aperture and said optical head lens being in optical alignment, said exit chamber communicating with said smokestack bore through an exit chamber mouth, said sealing air entering said exit chamber from said sealing air supply, and thence exiting said exit chamber into said smokestack bore through said exit chamber mouth.

16. The smoke density monitor of claim 15 wherein each said head housing further comprises a trap chamber separated from said head chamber by a second bulkhead and from said exit chamber by said first bulkhead, a second bulkhead aperture disposed in said second bulkhead, said first bulkhead aperture, said second bulkhead aperture and said optical head lens being in optical alignment, whereby dust or particulate matter which somehow crosses a sealing air barrier in said exit chamber will find itself in still air in said trap chamber and fall to a floor of said trap chamber as urged by gravity.

17. The smoke density monitor of claim 15 wherein said sealing air enters said exit chamber through a sealing air fitting, said sealing air fitting comprising a sealing air fitting valve, whereby a flow rate of said sealing air into said exit chamber may be regulated.

18. The smoke density monitor of claim 14 wherein said transmitter head and said receiver head each comprise an optical head slidably attached to a head housing, and means of hermetically sealing the slidable attachment between said optical head and said head housing, said optical head comprising an optical lens, whereby said optical head may be quickly and easily slid off said head housing for maintenance or servicing.

19. The smoke density monitor of claim 18 further comprising a mounting tube attached to said smokestack, said head housing being attached to said mounting tube.

20. The smoke density monitor of claim 19 wherein said head housing is attached to said mounting tube by means of a head housing thread sized to mate with a mounting tube thread.

21. The smoke density monitor of claim 20 wherein said mounting tube is attached to said smokestack by means of welding.

22. The smoke density monitor of claim 14 further comprising at least one alarm electrically connected to said density monitor, whereby said alarm will sound if smoke density within said smokestack bore exceeds a pre-selected threshold density.

23. The smoke density monitor of claim 14 further comprising an alarm monitor electrically connected to said density monitor, and at least one alarm electrically connected to said alarm monitor, whereby said alarm monitor may sound said alarm if smoke density within said smokestack bore exceeds a pre-selected threshold density.

24. The smoke density monitor of claim 14 further comprising a line to burner electrically connecting an alarm monitor to a burner, whereby said alarm monitor may send a signal to said burner to shut down said burner if smoke density within said smokestack bore exceeds a preselected threshold density.

25. The smoke density monitor of claim 14 further comprising a recorder electrically connected to an alarm monitor, whereby a record of smoke density within said smokestack bore may be preserved.

* * * * *